US007203590B2

(12) United States Patent
Schueler et al.

(10) Patent No.: US 7,203,590 B2
(45) Date of Patent: Apr. 10, 2007

(54) METHOD AND DEVICE FOR CONTROLLING AN INTERNAL COMBUSTION ENGINE

(75) Inventors: Matthias Schueler, Steinheim (DE); Michael Kessler, Leonberg-Warmbronn (DE); Nicole Kositza, Gerlingen (DE); Axel Loeffler, Backnang (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/233,619

(22) Filed: Sep. 23, 2005

(65) Prior Publication Data

US 2006/0173606 A1 Aug. 3, 2006

(30) Foreign Application Priority Data

Sep. 23, 2004 (DE) ..... 10 2004 046 082

(51) Int. Cl.
*F02D 41/14* (2006.01)
*F02P 5/152* (2006.01)

(52) U.S. Cl. ..... 701/105; 701/111

(58) Field of Classification Search ..... 701/105, 701/111, 113, 114, 115
See application file for complete search history.

(56) References Cited

U.S. PATENT DOCUMENTS 4,498,331 A * 2/1985 Nakamura et al. ..... 73/35.04
4,590,565 A * 5/1986 Takasu et al. ..... 701/111
5,339,245 A * 8/1994 Hirata et al. ..... 701/111
5,522,254 A * 6/1996 Kamabora et al. ..... 73/35.05
5,651,072 A * 7/1997 Nakao et al. ..... 381/71.2

FOREIGN PATENT DOCUMENTS

DE 103 05 656 1/2004

* cited by examiner

*Primary Examiner*—Willis R. Wolfe, Jr.
*Assistant Examiner*—Johnny H. Hoang
(74) *Attorney, Agent, or Firm*—Kenyon & Kenyon LLP

(57) ABSTRACT

A device and a method for controlling an internal combustion engine, in which, based on a signal that characterizes the vibrations of an internal combustion engine, at least one feature is determined and used to regulate and/or control operating parameters of the internal combustion engine. In order to generate the feature the signal of a sensor is filtered. Filtering selects low-frequency components of the signal.

11 Claims, 2 Drawing Sheets

METHOD AND DEVICE FOR CONTROLLING AN INTERNAL COMBUSTION ENGINE

BACKGROUND INFORMATION

A method and a device for controlling an internal combustion engine, in which, based on the signal from a structure-borne noise sensor, features used to regulate and/or control operating parameters of the internal combustion engine are determined, is described in German Patent No; DE 103 05 656. In order to generate the features, the signal from a sensor is filtered.

SUMMARY OF THE INVENTION

According to the present invention, it was determined that the structure-borne noise signal includes different information in different frequency ranges. Thus for example vibration resonances having specific frequencies arise. In spark-ignition internal combustion engines these are used for example to regulate knock. Furthermore, sounds in the 2–16 KHz frequency range arise. These high-frequency components are essentially due to the sounds caused by combustion. In other words, this signal reflects the sounds of explosion during combustion. Moreover, low-frequency vibrations in the 0–2 KHz range also arise, and are essentially due to stress in the engine block. Below, these are referred to as vibrations.

According to the present invention, based on the vibrations at least one feature is determined and used to control and regulate the internal combustion engine. In modern systems, partially homogeneous and/or homogeneous combustion methods are used and are characterized by a high rate of exhaust gas recirculation in combination with injection modified relative to conventional combustion in order to achieve a long ignition delay. In sub-ranges of the engine characteristics map, this combustion method is used in addition to conventional non-homogeneous combustion methods as an operating mode for reducing raw emissions of nitrogen and particles.

However, these homogeneous combustion methods are very sensitive, in particular with regard to tolerances in filling of the cylinder, which are a function of the air mass and the air/fuel ratio, and as a result the advantages of homogeneous combustion in controlled operation may only be partially exploited or not exploited at all. It is therefore advantageous if suitable features are detected and regulated here so as to approach specified values. Herein, an important feature characterizes the combustion status, e.g., as the angle for the start of combustion or the angle for a specific energy conversion percentage.

The effects upon combustion of tolerances in filling of the cylinder during partially homogeneous or homogeneous operation of a direct-injection internal combustion engine are detectable using a structure-borne noise sensor and may be offset by intervening in injection on a cylinder-individual basis and thus mitigated in a cost-effective manner. It is particularly advantageous if, based on the low-frequency structure-borne noise sensor, features are derived and regulated so as to approach predefined setpoint values. According to the present invention it was determined that, based on a low-frequency structure-borne noise signal, derived features characterize combustion particularly well. This considerably improves regulation of the internal combustion engine. Preferably a significant point in the low-frequency structure-borne noise signal is used as a feature.

It is particularly advantageous if the angle of a significant point in the low-frequency structure-borne noise signal is used as a feature. For example, the angular position of an inflection point between a local minimum and a local maximum, a local minimum, a local maximum and/or other variables may be used.

The angular position of these points, in particular of the inflection point, are directly associated, based on a fixed offset, with characteristic combustion conversion points, e.g. the start of combustion. In a particularly advantageous embodiment, the magnitude of the displacement is determined on a cylinder-individual basis.

The feature, in particular the angular position of a significant point, is predefined as a setpoint value and compared with the feature determined. Based on this comparison, a regulator specifies a manipulated variable so that the actual value approaches the setpoint value. It is true that the characteristic conversion point on the pressure curve and the angular position of the significant point in the structure-borne noise signal are not equal; nevertheless, regulating them produces similarly favorable results in terms of stabilizing the combustion process and narrowing tolerances with regard to emissions, moment, consumption, etc.

It is also advantageous if other sensors, e.g., wire strain gauges and/or flexion sensors, are used to detect the vibrations. Any sensors which detect engine block strain and cylinder head strain may be used as alternative sensors.

DETAILED DESCRIPTION

Figure 1:
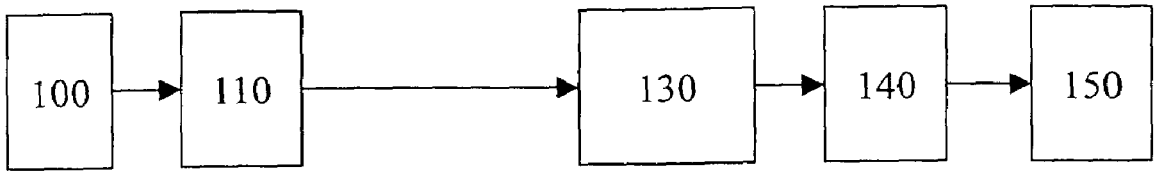
FIG. 1 shows a block diagram of the method according to the present invention.

In FIG. 1, an embodiment of the device according to the present invention is shown. The output signal of sensor 100 is sent via a filter 110 to an analyzer block 130, which determines the maximum resulting from combustion and the minimum between the compression maximum and the combustion maximum. The signal values between them are sent to an inflection point determining unit 140, which in turn sends a corresponding feature to a controller 150.

Filter 110 filters the output signal of sensor 100 so that signal components having low frequency are selected. This means that filter 110 is preferably a low-pass filter which passes on signal components having frequencies lower than about 1–2 KHz. Analyzer block 130 determines the angular position at which the signal is at a minimum and at a maximum.

Figure 3:
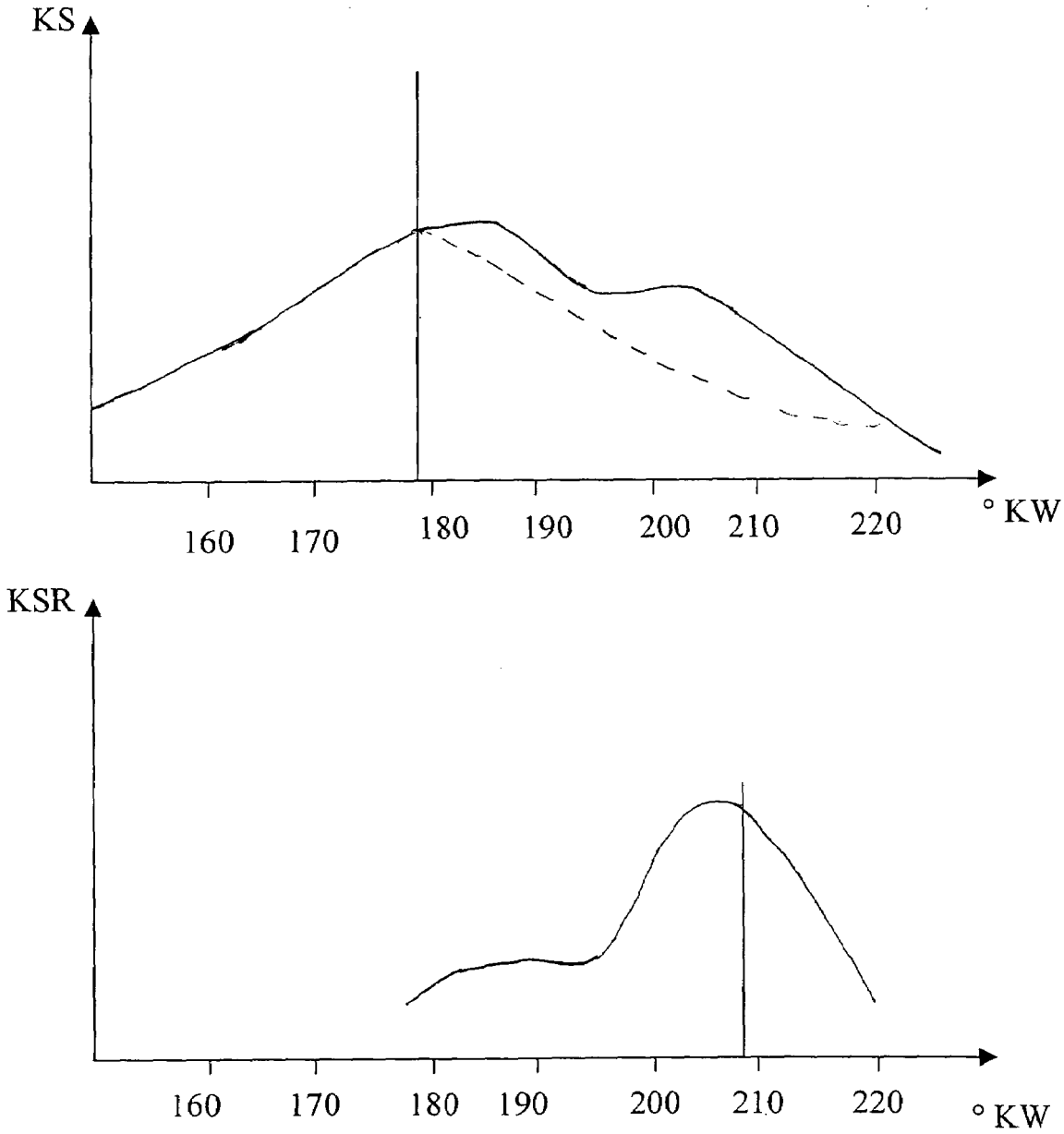
FIG. 3 shows various variables plotted against the angular position of the crankshaft.

FIG. 3 shows an exemplary signal curve. The amplitude of the filtered signal, i.e., output signal KS of value generator 120, is plotted against the angular position of the crankshaft KW. The structure-borne noise signal rises and reaches a first maximum between 180° and 190°. Thereafter, the signal falls, and rises again to a local maximum between 200° and 210° crankshaft angle. Thereafter it falls to its initial value.

According to the present invention, it was determined that the angle of the second maximum, which corresponds to the combustion maximum, and the angle of the minimum between the two maxima, characterize combustion, i.e., it is advantageous if one of these variables is regulated so as to approach a predefined setpoint value. It is particularly advantageous if the inflection point between the minimum and the second maximum is determined in inflection point determining unit 140, and the corresponding angular position of the crankshaft is sent to controller 150 as a feature.

Figure 2:
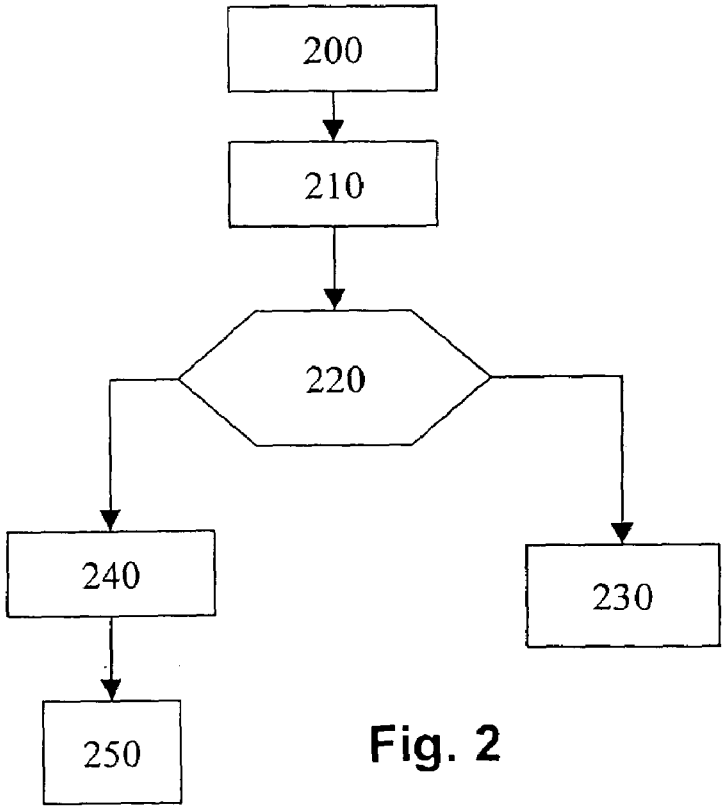
FIG. 2 shows a flow chart for the method according to the present invention.

FIG. 2 shows the corresponding calculation process as a flow chart. In a first step 200, starting from filtered signal KS, which corresponds to the signal amplitude of the signal, the minimum is determined and then in step 210 the maximum is determined. Next, in step 220 the inflection point is determined. Query 230 verifies whether in the angle range to be evaluated it was possible to calculate feature M selected for regulation. The angular position for feature M characterizes the combustion status and is used in 250 to regulate the combustion status. If this is not the case, the program ends at step 240.

It is particularly advantageous if the signal is only evaluated in the range between about 180° and 210°. Combustion usually occurs in this range of angles. Preferably the angular position of the crankshaft at which the corresponding filtered structure-borne noise signal is at an inflection point, a minimum or a maximum, is used as a feature of combustion.

Alternatively, the angular position at which a variable derived from the minimum, maximum and/or inflection point variables may be used as a feature. It is particularly advantageous if the angular position at which the mean of the minimum and maximum is reached or at which half the maximum is reached is used. Furthermore, it is advantageous if an arbitrary percentage median value between the minimum and the maximum is used.

A particularly advantageous embodiment for determining the angular position of the maximum is described below. In a first process step, a cylinder-individual reference signal R is generated from the curve of signal KS. This reference signal is independent of the changes in air mass. The reference signal is generated by reflecting the signal starting from a predefined start point of the crankshaft angle—in this exemplary embodiment it is 140°—to a specified end value of the crankshaft angle—in this example it is about 180°—at an associated axis. In FIG. 3 the axis is shown as a vertical line. Reference signal R is shown as a broken line.

The axis at which the reflection occurs is located at the end value. The end value at which the reflection occurs is derived from the angular position of the first maximum value of structure-borne noise signal KS. It is advantageous that the angular position of the maximum is reduced by a predefined offset angle. Based on structure-borne noise signal KS and aforementioned reference signal R, a relative structure-borne noise signal KSR is determined. To accomplish this, the structure-borne noise signal in question is divided by the reference signal in question for crankshaft angle w in question. Thus relative structure-borne noise signal KSR is determined using the following formula:

$$KSR(w)=KS(w)/R(w)$$

Based on the filtered signal, this means that a relative signal is determined through a comparison with reference signal R.

This produces a much better signal curve; in particular in the case of small air quantities and flat combustion maxima, there is a much clearer maximum, which is considerably easier to evaluate and determine than in the case of unprocessed structure-borne noise signal KS.

According to the present invention, based on this relative structure-borne noise signal KSR the corresponding features that characterize combustion are determined. These are preferably one or more of the following features, e.g., the angular position of the inflection point, the angular position of the minimum, the angular position of the maximum, the angular position of the value at which signal KSR reaches half of the maximum value and/or the angular position at which the structure-borne noise signal reaches the mean value between the minimum and the maximum.

The choice of offset angle for determining the reference signal influences the absolute magnitude of the maximum of structure-borne noise signal KSR. However, the angular position, i.e., the angle associated with the maximum, is not influenced by the processing of the signal. Moreover, displacement of the angular position of this kind would be irrelevant, as only the relative distance relative to the setpoint value is used in regulation, and the setpoint value is modified accordingly in the application phase.

Signal evaluation may be further improved if reference signal R is determined based on a structure-borne noise signal that has been determined over a plurality of cycles. This significantly reduces scattering between cycles.

Furthermore, to ensure that signals are more easily compared graphically, signal KSR may be scaled to a range between 0 and 1.

The features determined in this way are sent to a regulator, in which, based on operating parameters, a setpoint value for the feature is specified. On the basis of the comparison between the setpoint value and the feature determined, a regulator specifies a manipulated variable. Using this manipulated variable, a trigger signal for an actuator is then generated. Moreover, additional variables may also be used to generate the trigger signal for the actuator. Preferably, the start of triggering of the actuator that influences fuel feed, and/or a signal for influencing the quantity of fresh air supplied to the internal combustion engine and/or the exhaust gas recirculation rate are used as the trigger signal. In other words, the start of injection is modified preferably as a function of the comparison between the setpoint value and the actual value for the feature so that the feature approaches the setpoint value. Alternatively or in addition thereto, the quantity of fresh air and the quantity of exhaust gas recirculated may additionally be modified accordingly so that the feature approaches the setpoint value.

In order to influence the start of the injection, preferably the trigger signal for activation of an injector is triggered, and in order to influence the quantity of air preferably an exhaust gas recirculation valve, a throttle valve and/or a turbocharger are triggered accordingly.

What is claimed is:

1. A method for controlling an internal combustion engine comprising:

based on a signal which characterizes vibrations of the internal combustion engine, determining at least one feature and using the feature to at least one of regulate and control operating parameters of the internal combustion engine; and filtering a signal of a sensor in order to generate the feature, wherein the filtering selects low-frequency components of the signal, and wherein the feature is generated from the selected low-frequency components.

2. The method according to claim 1, further comprising determining at least one of a minimum of the filtered signal, a maximum of the filtered signal and an inflection point on a signal curve.

3. The method according to claim 2, wherein an angular position at which the filtered signal is at one of the minimum, the maximum and the inflection point is used as the feature.

4. The method according to claim 2, wherein an angular position at which the filtered signal is at a variable derived from one of the minimum, the maximum and the inflection point is used as the feature.

5. The method according to claim 1, wherein the feature characterizes at least one of a start of combustion and an angle for a predetermined energy conversion percentage.

6. The method according to claim 1, wherein at least one of a start of injection and an air quantity is at least one of regulated and controlled as operating parameters.

7. The method according to claim 1, further comprising, based on the filtered signal, generating a relative signal by carrying out a comparison with a reference signal.

8. A device for controlling an internal combustion engine, comprising:

means for determining, based on a signal that characterizes vibrations of the internal combustion engine, at least one feature used to at least one of regulate and control operating parameters of the internal combustion engine, the means for determining including a filter that filters a signal of a sensor, the filter selecting low-frequency components of the signal, wherein the at least one feature is determined based on the selected low-frequency components.

9. The method according to claim 1, wherein the feature is an angle that characterizes a combustion status.

10. The method according to claim 1, wherein the low-frequency components are in a range of 0 to 2 KHz.

11. A method for controlling an internal combustion engine comprising:

based on a signal which characterizes vibrations of the internal combustion engine, determining at least one feature and using the feature to at least one of regulate and control operating parameters of the internal combustion engine; and filtering a signal of a sensor in order to generate the feature;

wherein:

the filtering selects frequency components of the signal that correspond to engine block stress; and the feature is generated from the selected frequency components.

* * * * *